US005390740A

United States Patent [19]

Woerheide

[11] Patent Number: 5,390,740

[45] Date of Patent: Feb. 21, 1995

[54] METHOD AND APPARATUS TO RECYCLE PRODUCTION WELL CASING VAPOR

[75] Inventor: Edward A. Woerheide, Houston, Tex.

[73] Assignee: Texaco Inc., White Plains, N.Y.

[21] Appl. No.: 168,292

[22] Filed: Dec. 17, 1993

[51] Int. Cl.[6] ..... E21B 43/24

[52] U.S. Cl. ..... 166/266; 166/52; 166/90; 166/267; 166/272

[58] Field of Search ..... 166/267, 266, 272, 303, 166/52, 90

[56] References Cited

U.S. PATENT DOCUMENTS

| | | | |
|---|---|---|---|
| 3,412,794 | 11/1968 | Craighhead | 166/272 |
| 3,460,621 | 8/1969 | Gum et al. | 166/272 X |
| 3,608,638 | 9/1971 | Terwilliger | 166/272 |
| 3,918,521 | 11/1975 | Snavely, Jr. et al. | 166/272 |
| 4,018,481 | 4/1977 | Terry | 166/267 X |
| 4,160,479 | 7/1979 | Richardson et al. | 166/272 X |
| 4,488,598 | 12/1984 | Duerksen | 166/266 X |
| 5,085,275 | 2/1992 | Gondouin | 166/303 |

*Primary Examiner*—Hoang C. Dang

*Attorney, Agent, or Firm*—James L. Bailey; Kenneth R. Priem; Russell J. Egan

[57] ABSTRACT

In a steam flood enhanced oil recovery operation, vapor and liquid in the casing annulus of the production wells is forwarded through a liquid separator with the thus separated vapor being forwarded to an eductor at the injection well where the vapor is mixed with incoming steam for injection and circulation through the formation.

2 Claims, 2 Drawing Sheets

METHOD AND APPARATUS TO RECYCLE PRODUCTION WELL CASING VAPOR

BACKGROUND OF THE INVENTION

1. The Field of the Invention

The present invention relates to a method and apparatus to recycle production well casing steam, thereby providing substantial economic savings while reducing environmental concerns.

2. The Prior Art

Heretofore, in enhanced oil recovery steam floods, a portion of the injected steam traverses the formation and returns to the surface via the production well annulus mixed with distilled hydrocarbons and other compounds from the reservoir. This casing vapor mixture is collected from all the production wells to a central station where it is cooled to liquify for collection of the steam and at least some of the hydrocarbons. The non-condensible vapors have generally been disposed of by incineration. However, these non-condensibles often include hydrogen sulfides, which oxidize to form sulfur oxides, and thus must not exceed maximum acceptable values in order for the resulting flue gas from the incineration to meet environmental standards.

The prior art methods for a steam flood have some economic disadvantages. The steam that returns to the surface is generally treated as a low grade heat source that is not economic to recover or use. In fact energy is expended to condense the steam to allow recovery of the hydrocarbons in the casing vapor mixture. This prior art system of treating the steam portion of the casing vapor mixture as though it was a totally spent product results in substantial loss of heat with no economic advantage being derived therefrom, especially since steam is generally costly to generate. This method of treating the steam as totally used up also has adverse environmental consequences in its disposal.

An example of steam injection into a reservoir for a more complete recovery of the hydrocarbons contained therein can be found in U.S. Pat. No. 3,460,621, the disclosure of which is incorporated herein by reference. It is also known to use at least a portion of the product recovered from the reservoir as a source of energy to continue the production cycle. An example of this can be found in U.S. Pat. No. 4,160,479, the disclosure of which is also incorporated herein by reference. Further, it is known that one problem with steam flooding is maintaining the quality of the steam as this has a direct effect on the amount of heat imparted to the formation by the steam. A system for conserving steam quality is disclosed in U.S. Pat. No. 5,085,275, the disclosure of which is incorporated herein by reference.

SUMMARY OF THE PRESENT INVENTION

The present invention proposes a method and apparatus for recycling production well casing vapor, resulting from steam flooding of a reservoir, for more effective and efficient use of the steam while protecting the environment. The present invention is used in any field completed with an patterned array of injection and producing wells. According to the present invention, a steam and high pressure casing vapor mixture is injected into the reservoir from the injection wells and enters near the top of the oil bearing formation. A portion of the mixture traverses the formation to a lower level at a production well. Here it is returned to the surface as casing vapor via the casing annulus. At the surface, produced fluids are sent to a gathering station and the casing vapor and entrained fluids are passed to a liquid separator, where the vapor is separated from the liquid. The vapor is forwarded to an eductor where it is combined with high pressure steam from the steam generation plant, to increase the casing vapor pressure, and the combined steam and casing vapor are sent down an injection well to the formation.

BRIEF DESCRIPTION OF THE DRAWINGS

The present invention will now be described, by way of example, with reference to the accompanying drawings in which.

DETAILED DESCRIPTION OF THE INVENTION

Figure 1:
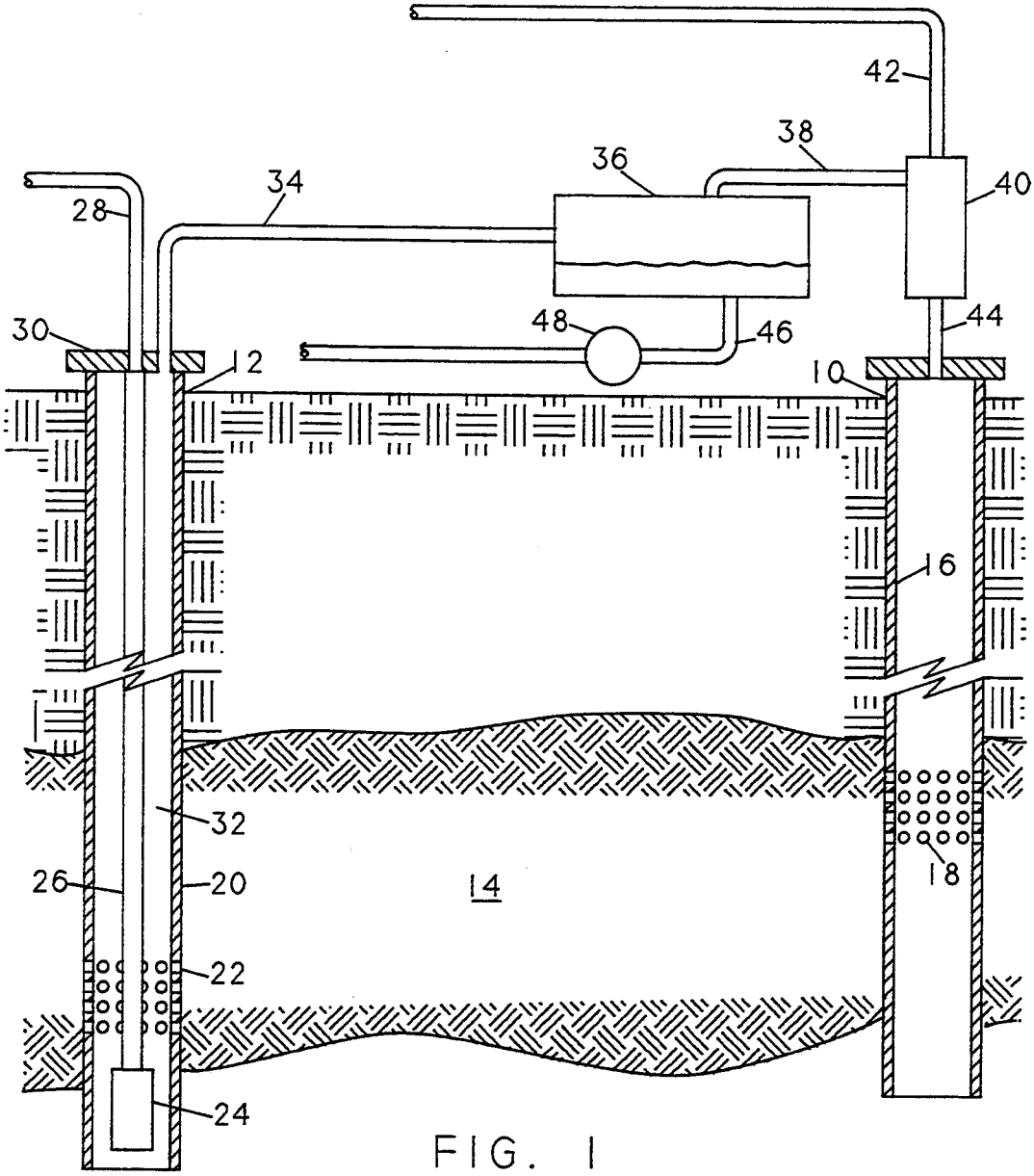
FIG. 1 is a schematic vertical section through a portion of an oil field being treated by steam flood and utilizing the present invention.

A typical production oil field being treated by steam flooding and using the present invention is shown in FIG. 1. At least one injector well 10 and at least one production well 12 penetrate to a hydrocarbon bearing formation 14 which is to be treated by steam flooding. It is to be understood that the wells illustrated represent a plurality of wells in a patterned array in an established field. The casing 16 of the injector well 10 is perforated by a plurality of perforations 18 near the upper portion of the formation 14 while the casing 20 of the production well 12 is perforated by a plurality of perforations 22 near the lower portion of the formation 14. The production well 12 has included therein a pump 24 and production tubing 26, which rises to the surface and is connected to a gathering station (not shown) by pipe 28. The production casing 20 is closed by cap 30 so that vapor and fluid produced via the casing annulus 32 can be captured and forwarded via pipe 34 to a liquid separator 36. The vapor portion is recovered in the separator and forwarded, via pipe 38, to an eductor 40, which is also connected to a high-pressure steam line 42 from a steam generator (not shown) and to the injection well 10 via pipe 44. It should be here noted that eductors are also known as jet compressors and as thermal compressors. A drain line 46 and pump 48 are connected to the separator 36 to handle the accumulated liquid. The production well annulus is used to maintain a desirable amount of casing vapor flow from the reservoir to each producing well.

In the example illustrated, steam at 170 psi arrives at the eductor 40 from the generator station (not shown) while steam vapor from the liquid separator 36, at approximately 85 psi, is forwarded to the eductor 40 with the result of steam at approximately 120 psi being supplied to the injector well 10. The perforations 18 in the injection well casing 16 are such that there is relatively low pressure drop across the perforations so that the pressure inside the casing at the perforations is approximately 115 psi. The steam pressure loss in the steam chest, between the injector well 10 and production well 12, is expected to be slightly greater than 5 psi, but this still leaves steam of sufficient pressure to maintain the steam chest temperature in the reservoir.

In a conventional steam flood operation, the steam will distill and carry with it the lighter hydrocarbon products from the reservoir. The prior art steam flood operation included condensers to liquify hydrocarbons and steam collected from the producing wells. The injected steam was condensed, after a single pass through the reservoir, and the lighter hydrocarbon products recovered with the non-condensible vapor simply being burned off. This, as previously mentioned, has resulted in the emission of sulfur oxides into the atmosphere as well as the loss of the heat in the steam. Both of these have had an adverse effect on the environment by generating unnecessary sulfur oxides, dissipating heat and creating water which must be treated before being discharged.

In the present system the recirculation of the vapor recovered from the casing annulus of production well recirculates not only the steam, but some of these lighter hydrocarbons which tend to reduce the viscosity of other hydrocarbon products remaining in the formation. Thus a more complete recovery of hydrocarbons from the reservoir is obtained.

Figure 2:
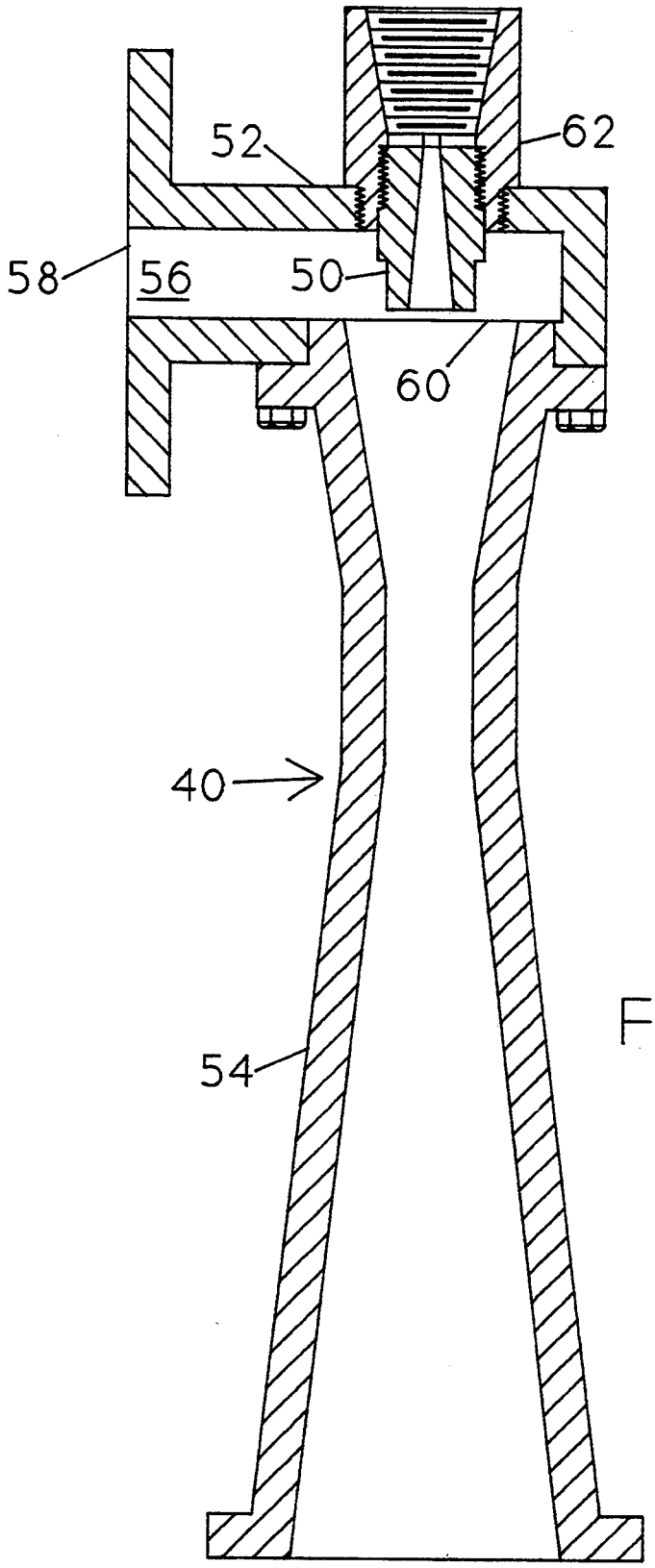
FIG. 2 is a vertical section through an eductor of a type utilized effectively in the present invention.

One known eductor 40, also known as a jet compressor or thermal compressor, is shown in FIG. 2 and has three basic components, namely, a nozzle 50, a housing or body 52 and a diffuser 54. The housing or body 52 defines a chamber 56 with a suction inlet 58, a diffuser outlet 60, and a nozzle mounting 62. The design of the nozzle 50 follows basic thermodynamic laws. The motive gas, under pressure from the steam generator (not shown), enters the eductor 40 via pipe 42 and flows through the nozzle 50. The nozzle 50 converts the potential energy of this high pressure vapor into the kinetic energy of a high velocity jet stream which has a lower pressure. This lower pressure is less than that of the casing vapor pressure and allows entrainment of the casing vapor from the separator 36 through pipe 38 and the suction inlet 58. The motive and suction gases are mixed in the chamber 56 of the housing or body 52 and exit the diffuser outlet 60. The diffuser 54 then converts the velocity head of the motive and suction gas mixture to a static head so that the proper discharge pressure can be obtained.

The present invention concerns recycling recovered production well casing vapor and reinjecting at least a portion of the recovered casing vapor into the reservoir. A theory describing the mechanism of steam flood oil recovery gaining acceptance is that in a mature steam flood a steam chest develops above the oil-saturated reservoir and steam will flow from the injector to the producer wells. Then gravity drainage becomes the dominant recovery mechanism and steam flow drag of the hot liquids is a minor recovery mechanism. The oil recovery efficiency of this thermal process with gravity drainage is not affected by the steam chest pressure. Calculated pressure losses for the steam flow across the steam chest, from the injector well to the producing well, is only a few pounds. The optimum amount of steam to inject is equal to the heat loss to the rock above and below the steam zone, the heat absorbed by fluids and solids in the oil reservoir, in the produced fluids, and steam leaving the pattern via the producing well annulus or migrating to adjacent patterns.

The concept of the present invention is shown in the attached drawings as a closed loop system using an eductor with high pressure steam as the motive force to compress the casing blow vapor to the injector wellhead pressure. The amount of high pressure steam required to operate the eductor will equal all the heat losses, less the amount of heat in the recovered casing vapor. The steam portion of the casing vapor is the excess injection steam which does not condense in the reservoir or migrate outside the pattern.

This closed loop system can be modeled to size all the system elements i.e. the injector tubing and perforations, production casing perforations, annulus, pipe and eductor per the schematic. High pressure steam mass rate to maintain the steam chest is determined by net system heat loss. Each pattern would use an eductor at each injection well that compresses casing vapor collected from producer wells in the injector well pattern.

Such a closed loop casing vapor system provides two advantages: (1) Recovery of all heat in the casing vapors except for pipeline surface heat loss; (2) Elimination of facilities and power costs to condense and dispose of casing vapor. Gas lift fluids can still be separated from casing vapor and treated as produced fluid.

The present invention may be subject to many modifications and changes without departing from the spirit or essential characteristics thereof. The scope of the present invention is therefore to be determined by the appended claims rather than the foregoing description which is intended as illustrative only.

I claim:

1. A method for recovering and recycling production well casing vapor in a producing field wherein a patterned array of injection and production wells penetrate into a hydrocarbon containing formation to be steam flooded, comprising the steps of:

providing each injection well with casing perforated near the upper side of the formation to be treated;

providing each production well with casing perforated near the bottom of the formation, a cap closing the upper end of the casing, and production pipe extending downhole forming an annulus with the casing;

providing liquid separator means and pipe means connecting the casing annulus to the liquid separator means; providing eductor means;

providing said liquid separator means with pipe means connecting the liquid separator means to the eductor means whereby separated vapor from the liquid separator means is forwarded to said eductor means;

providing a source of pressurized steam to the eductor means whereby high pressure steam from said steam source and recovered vapors from the liquid separator means are combined and flow through the injection well to the steam chest and to the production well.

2. A system for recycling production well casing vapor in a secondary oil recovery operation in a producing field having a patterned array of injection and production wells penetrating a hydrocarbon bearing formation, comprising:

at least one injection well having a casing perforated at an upper portion of a formation to be steam flooded;

at least one production well having casing perforated at a lower portion of said formation;

an eductor;

a source of high pressure steam connected to said eductor;

liquid separator means connected to said eductor;

means to collect casing vapor rising in each production well casing and to forward the vapor to said liquid separator means, said liquid separator means forwarding the vapor to said eductor and the liquid to a gathering station, whereby recovered casing vapor is combined with fresh steam and sent to the formation under treatment.

* * * * *